US008123573B2

(12) United States Patent
Takehara et al.

(10) Patent No.: US 8,123,573 B2
(45) **Date of Patent: *Feb. 28, 2012**

(54) CONNECTION STRUCTURE

(75) Inventors: Hideaki Takehara, Hitachi (JP); Kunihiro Fukuda, Tsukuba (JP); Sachio Suzuki, Hitachi (JP); Yuta Kataoka, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/784,023

(22) Filed: May 20, 2010

(65) Prior Publication Data

US 2011/0130028 A1 Jun. 2, 2011

(30) Foreign Application Priority Data

Nov. 30, 2009 (JP) ..... 2009-272319

(51) Int. Cl.
*H01R 13/00* (2006.01)

(52) U.S. Cl. ..... 439/845

(58) Field of Classification Search ..... 439/485, 439/157, 152, 160, 372, 161, 196, 519, 218
See application file for complete search history.

(56) References Cited

U.S. PATENT DOCUMENTS

| | | | | |
|---|---|---|---|---|
| 6,114,413 | A * | 9/2000 | Kang et al. | 523/210 |
| 6,234,842 | B1 | 5/2001 | Keay et al. | |
| 6,981,805 | B2 * | 1/2006 | Miller et al. | 385/92 |
| 7,588,456 | B2 | 9/2009 | Zhu et al. | |
| 7,837,496 | B1 | 11/2010 | Pal | |
| 7,922,518 | B1 * | 4/2011 | Takehara et al. | 439/485 |
| 2007/0001310 | A1 * | 1/2007 | Hua et al. | 257/762 |
| 2009/0075506 | A1 | 3/2009 | Suzuki | |

FOREIGN PATENT DOCUMENTS

| | | | |
|---|---|---|---|
| JP | 2000-208177 | A | 7/2000 |
| JP | 2004-056924 | A | 2/2004 |
| JP | 2007-258010 | A | 10/2007 |
| JP | 4037199 | B2 | 11/2007 |
| JP | 2009-070754 | A | 4/2009 |

OTHER PUBLICATIONS

H. Takehara et al., U.S. PTO Notice of Allowance, U.S. Appl. No. 12/783,711, dated Dec. 8, 2010, 7 pgs.

* cited by examiner

*Primary Examiner* — Alexander Gilman

(74) *Attorney, Agent, or Firm* — Foley & Lardner LLP

(57) ABSTRACT

A connection structure includes a first terminal housing with first connecting terminals, a second terminal housing with second connecting terminals, isolating plates in the first terminal housing, a connecting member to collectively fix the first connecting terminals and the second connecting terminals at the contacts therebetween for electrical connections between the first connecting terminals and the second connecting terminals. The connection structure is adapted to heat generated at the contacts through the connecting member, the first terminal housing and/or the second terminal housing to an outside of the first terminal housing.

12 Claims, 5 Drawing Sheets

1 CONNECTOR
4a-4c FIRST CONNECTING TERMINALS
5 FIRST TERMINAL HOUSING
6a-6c FIRST CONNECTING TERMINALS
7 SECOND TERMINAL HOUSING
9 CONNECTING MEMBER

1 CONNECTOR
4a-4c FIRST CONNECTING TERMINALS
5 FIRST TERMINAL HOUSING
6a-6c FIRST CONNECTING TERMINALS
7 SECOND TERMINAL HOUSING
8a-8d ISOLATING PLATES
9 CONNECTING MEMBER
24 FLANGE 4a-4c FIRST CONNECTING TERMINALS
5 FIRST TERMINAL HOUSING
6a-6c FIRST CONNECTING TERMINALS
7 SECOND TERMINAL HOUSING
8a-8d ISOLATING PLATES
9 CONNECTING MEMBER

CONNECTION STRUCTURE

The present application is based on Japanese patent application No. 2009-272319 filed on Nov. 30, 2009, the entire contents of which are incorporated herein by reference.

BACKGROUND OF THE INVENTION

1. Field of the Invention

The present invention relates to a connection structure, for use in eco-friendly cars, such as hybrid vehicles, electric vehicles and the like, and in particular, for being capable of use for a portion to connect a power harness, which is used for large power transmission.

2. Description of the Related Art

In hybrid vehicles, electric vehicles and the like which have remarkably developed in recent years, a power harness, which is used for large power transmission for connection between devices, has at its one end a connector, which has two separate portions: a male connector portion with a male terminal and a first terminal housing accommodating the male terminal, and a female connector portion with a female terminal connected with the male terminal and a second terminal housing accommodating the female terminal (e.g., JP-A-2009-070754).

In recent years, such eco-friendly cars have been designed to reduce the weights of all parts thereof, to enhance the energy saving performance of the cars. As one effective means to reduce the weights of parts of the cars, it has been proposed to reduce the sizes of the parts.

For example, a technique as described below, which has been disclosed by JP patent No. 4037199, is known in the art.

JP patent No. 4037199 discloses an electrical connection structure for a vehicle, which is for connecting multiphase connecting terminals of a conductive member drawn out from a motor for driving the vehicle, and multiphase connecting terminals of a power line cable drawn out from an inverter for driving the motor. The technique used in the electrical connection structure disclosed by JP patent No. 4037199 is as follows: Each phase connecting terminal of the conductive member and each corresponding phase connecting terminal of the power line cable are overlapped, and isolating members are disposed on opposite surfaces to the overlapped surfaces of the connecting terminals, respectively, and these overlapped connecting terminals and isolating members are collectively fastened in an overlapping direction with a single bolt provided in a position to penetrate these overlapped connecting terminals and isolating members.

That is, in the technique used in the electrical connection structure disclosed by JP patent No. 4037199, the single bolt is tightened in the overlapping direction, to collectively hold the multiplicity of contacts between the connecting terminals, which are the overlapped surfaces of the connecting terminals, and thereby fix the connecting terminals at the contacts therebetween, for electrical connections between the connecting terminals, respectively. The construction of JP patent No. 4037199 is effective in easily ensuring size reduction, compared to a technique disclosed by JP-A-2009-070754.

The related arts to the invention are, e.g., JP-A-2009-070754, JP patent No. 4037199, JP-A-2000-208177 and JP-A-2007-258010.

Here, the power harness used for large power transmission needs to dissipate heat generated at the contacts due to the large power transmission. Thus, one problem is to structure an effective heat-dissipating route.

However, in the structure of JP patent No. 4037199, the structuring of the effective heat-dissipating route has not been completed.

SUMMARY OF THE INVENTION

Accordingly, it is an object of the invention to provide a connection structure with an effective heat-dissipating route, wherein the connection structure is made such that, when a first terminal housing is fitted to a second terminal housing, plural first connecting terminals are each opposed to and paired with plural second connecting terminals and the first connecting terminals, the second connecting terminals and isolating plates are stacked.

(1) According to one embodiment of the invention, a connection structure comprises:

a first terminal housing with a plurality of first connecting terminals aligned and accommodated therein;

a second terminal housing with a plurality of second connecting terminals aligned and accommodated therein;

a plurality of isolating plates aligned and accommodated in the first terminal housing, wherein when the first terminal housing and the second terminal housing are fitted to each other, the plurality of first connecting terminals and the plurality of second connecting terminals face each other to form pairs, respectively, and a stacked state is exhibited such that pairs of the first connecting terminals and the second connecting terminals are alternately interleaved with the plurality of isolating plates; and a connecting member comprising a heat-conducting material and a main body including a head and a shaft connected to the head, the shaft being adapted to penetrate contacts between the plurality of first connecting terminals and the plurality of second connecting terminals and the plurality of isolating plates, the head being adapted to press an adjacent one of the plurality of isolating plates for collectively fixing the plurality of first connecting terminals and the plurality of second connecting terminals at the contacts for electrical connections between the plurality of first connecting terminals and the plurality of second connecting terminals, respectively, the connecting member further comprising at least a portion comprising a nonconductive material for penetrating the contacts, wherein the connection structure is adapted to dissipate heat generated at the contacts through the connecting member, the first terminal housing and/or the second terminal housing to an outside of the first terminal housing.

In the above embodiment (1), the following modifications and changes can be made.

(i) The head of the main body is in thermally close contact with the first terminal housing and/or the second terminal housing so as to dissipate heat generated at the contacts through the head of the main body, the first terminal housing and/or the second terminal housing to the outside of the first terminal housing.

(ii) The connecting member further comprises a nonconductive portion formed of a nonconductive material and covering an outer circumference of a part except a tip section of the shaft of the main body, the head and the shaft of the main body comprise a metal, and the tip section of the shaft of the main body is in thermally close contact with the first terminal housing and/or the second terminal housing.

(iii) The tip section of the shaft of the main body comprises a male screw formed thereon, and the connecting member is fixed in thermally close contact with the first terminal housing and/or the second terminal housing by screwing the tip section of the shaft into a female screw formed on the first terminal housing and/or the second terminal housing.

(iv) The head of the main body comprises a heat-insulating cap for preventing a human body part from touching the heated connecting member.

(v) The first terminal housing and/or the second terminal housing comprise a flange formed integrally on an outer circumference thereof for fixing the first terminal housing and/or the second terminal housing to a housing of an external device so as to allow the first terminal housing and/or the second terminal housing to have a thermally close contact with the housing of the external device, and the connection structure is adapted to dissipate heat generated at the contacts through the connecting member, the first terminal housing and/or the second terminal housing, and the flange to the external device.

(vi) The plurality of isolating plates comprise a nonconductive and heat-conducting material, and at least one of the plurality of isolating plates is in thermally close contact with the first terminal housing and/or the second terminal housing so as to further dissipate heat generated at the contacts through the plurality of isolating plates, first terminal housing and/or the second terminal housing to the outside of the first terminal housing.

(2) According to another embodiment of the invention, a connection structure comprises:

a first terminal housing with a plurality of first connecting terminals aligned and accommodated therein;

a second terminal housing with a plurality of second connecting terminals aligned and accommodated therein;

a plurality of isolating plates aligned and accommodated in the first terminal housing, wherein when the first terminal housing and the second terminal housing are fitted to each other, the plurality of first connecting terminals and the plurality of second connecting terminals face each other to form pairs, respectively, and a stacked state is exhibited such that pairs of the first connecting terminals and the second connecting terminals are alternately interleaved with the plurality of isolating plates; and a connecting member comprising a heat-conducting material and a head, the head being adapted to press an adjacent one of the plurality of isolating plates for collectively fixing the plurality of first connecting terminals and the plurality of second connecting terminals at the contacts for electrical connections between the plurality of first connecting terminals and the plurality of second connecting terminals, respectively, wherein the plurality of isolating plates comprise a nonconductive and heat-conducting material, and at least one of the plurality of isolating plates is in thermally close contact with the first terminal housing and/or the second terminal housing so as to dissipate heat generated at the contacts through the plurality of isolating plates, first terminal housing and/or the second terminal housing to an outside of the first terminal housing.

In the above embodiments (1) and (2), the following modifications and changes can be made.

(vii) The first terminal housing and/or the second terminal housing comprise a metallic material.

(viii) The first terminal housing and/or the second terminal housing comprise a heat-conducting resin.

Points of the Invention

According to one embodiment of the invention, a connection structure is constructed such that heat generated from each contact is dissipated through a connecting member and a first terminal housing to the outside of the first terminal housing. The connecting member, which serves to collectively fix at each contact the plural first connecting terminals and the plural second connecting terminal for electrical connection therebetween by pressing an adjacent isolating plate, also serves as a heat-dissipating route for dissipating heat generated from each contact to the outside of the first terminal housing. Thus, the effective heat-dissipating route can be completed without increasing the number of parts.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Below is described a preferred embodiment of the invention, referring to the accompanying drawings.

Herein is described a connector as one example of a connection structure of the invention.

Figure 1:
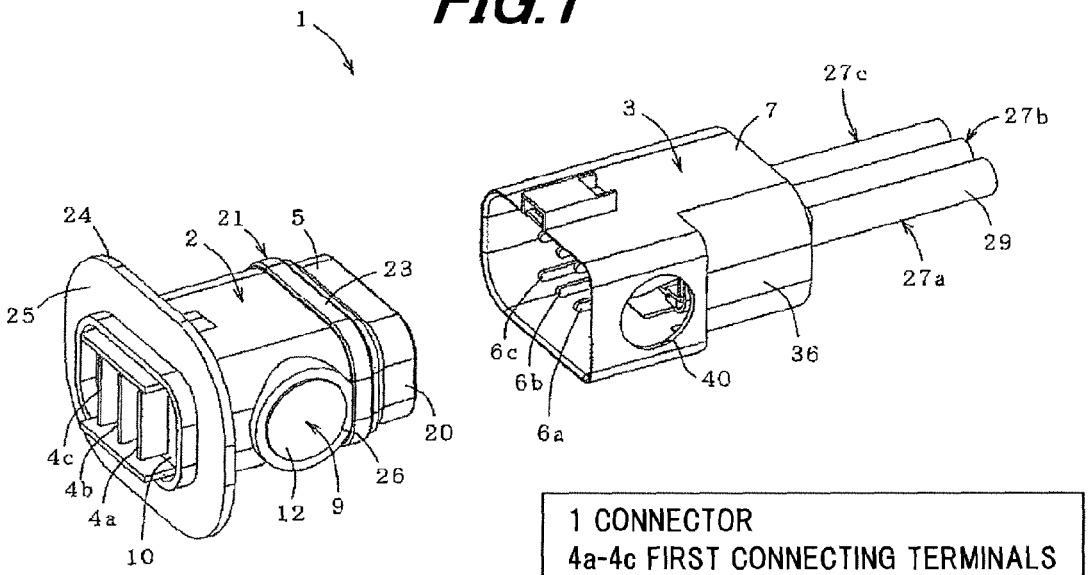
FIG. 1 is a perspective view showing a first connector portion and a second connector portion of a connector in an embodiment according to the invention.
Figure 2:
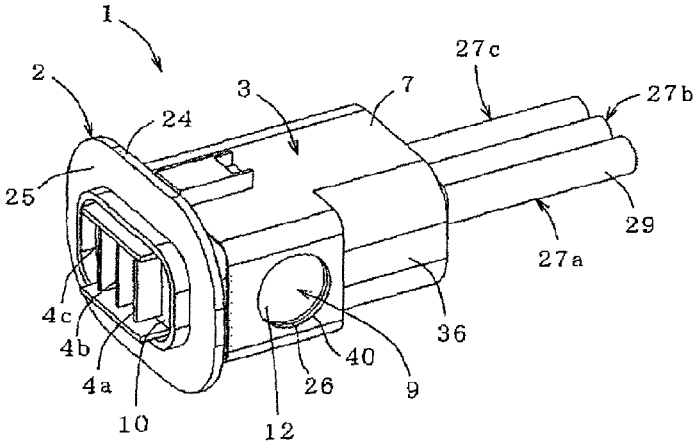
FIG. 2 is a perspective view showing a connection state between the first connector portion and the second connector portion of the connector in FIG. 1.
Figure 3:
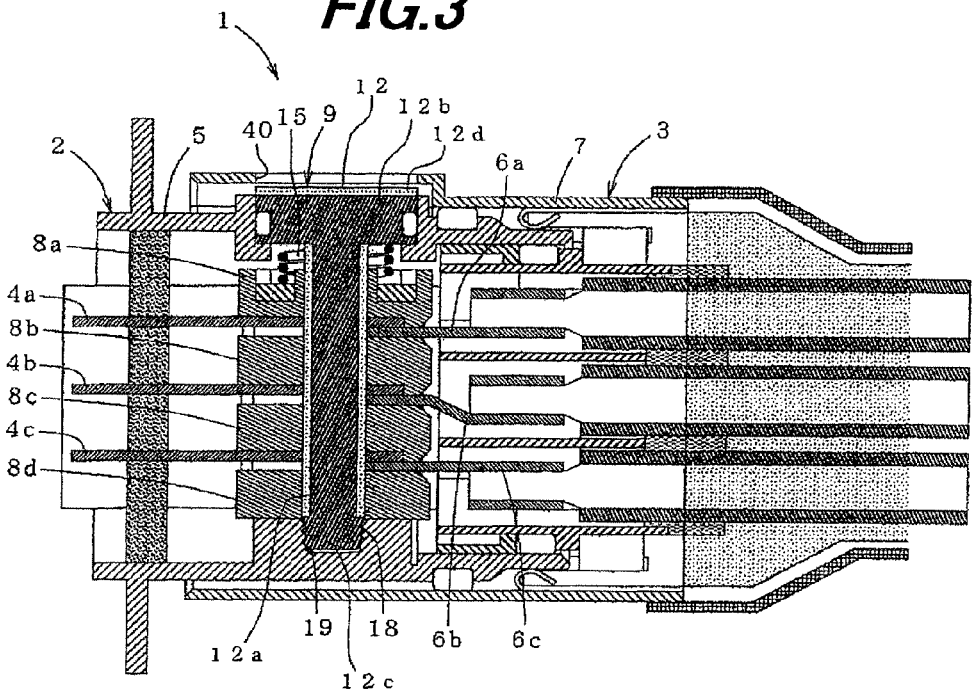
FIG. 3 is a cross-sectional view showing the connection state between the first connector portion and the second connector portion of the connector in FIG. 1.

FIG. 1 is a perspective view showing a first connector portion and a second connector portion (i.e., a pre-connection state therebetween) of a connector in the embodiment according to the invention. FIG. 2 is a perspective view showing a connection state between the first connector portion and the second connector portion of the connector in FIG. 1. FIG. 3 is a cross-sectional view showing the connection state therebetween. Meanwhile, in FIGS. 1 to 4, 6 and 9 to 11, a concave portion for fitting a hexagonal wrench (or a hexagonal spanner) thereinto is omitted which is formed on the upper surface of a head 12*b* of a connecting member 9.

Structure of Connector 1

As shown in FIGS. 1 to 3, the connector 1 in this embodiment is comprised of a first connector portion 2 and a second connector portion 3 which are fitted each other to collectively connect plural power lines.

For example, the connector 1 includes the first connector portion 2 having a first terminal housing 5 with a plurality of (three) first connecting terminals (male terminals) 4*a* to 4*c* aligned and accommodated therein, the second connector portion 3 having a second terminal housing 7 with a plurality of (three) second connecting terminals (female terminals) 6*a* to 6*c* aligned and accommodated therein, and a plurality of isolating plates 8*a* to 8*d* aligned and accommodated in the first terminal housing 5. When the first terminal housing 5 of the first connector portion 2 is fitted into the second terminal housing 7 of the second connector portion 3, the plural first connecting terminals 4*a* to 4*c* are each opposed to and paired with the plural second connecting terminals 6*a* to 6*c* (i.e., forming pairs of the first connecting terminal 4*a* and the second connecting terminal 6*a*, the first connecting terminal 4*b* and the second connecting terminal 6*b*, and the first connecting terminal 4*c* and the second connecting terminal 6*c*) and they are stacked such that the plural isolating plates 8*a* to 8*d* sandwich each pair of the first connecting terminals 4*a* to 4*c* and the second connecting terminals 6*a* to 6*c*. In other words, the connector 1 of the embodiment can be arranged such that when the first terminal housing 5 of the first connector portion 2 is fitted into the second terminal housing 7 of the second connector portion 3, the plural first connecting terminals 4*a* to 4*c*, the plural second connecting terminals 6*a* to 6*c* and the plural isolating plates 8*a* to 8*d* are stacked.

This connector 1 is used for connecting, e.g., a vehicle drive motor and an inverter for diving the motor.

For example, the first terminal housing 5 (i.e., a left side portion in FIG. 1) of the first connector portion 2 is fitted into a shield case of the motor, and the first connecting terminal 4*a* to 4*c* portions exposed from the first terminal housing 5 are connected to terminals, respectively, of a terminal block installed in the shield case of the motor. The motor can be electrically connected with the inverter by fitting into the first connector portion 2 the second connector portion 3 electrically connected with the inverter. Although the foregoing is concerned with the motor-side connection, the same applies to the inverter-side connection.

First and Second Connector Portions 2, 3

Below are described the respective specific structures of the first connector portion 2 and the second connector portion 3.

First Connector Portion 2

Figure 4:
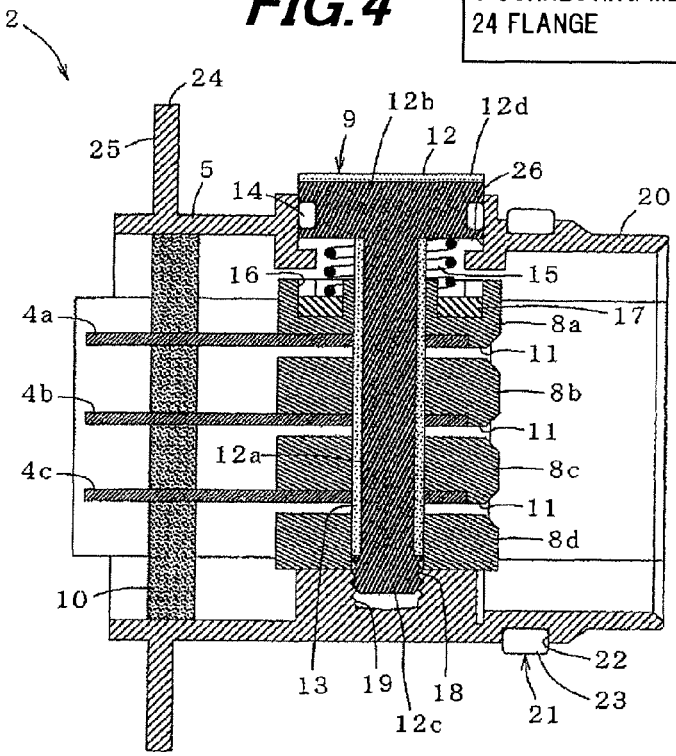
FIG. 4 is a cross-sectional view showing the first connector portion of the connector in FIG. 1.

Referring to FIG. 4, the first connector portion 2 has the three first connecting terminals 4*a* to 4*c* held therein to be aligned at a specified pitch, and includes the first terminal housing 5 for accommodating the three aligned first connecting terminals 4*a* to 4*c*, the plural substantially rectangular parallelepiped isolating plates 8*a* to 8*d* provided in the first terminal housing 5 for isolating each of the first connecting terminals 4*a* to 4*c*, and the connecting member 9 with the head 12*b* and a shaft 12*a* connected to the head 12*b*, whose shaft 12*a* penetrates each contact between the plural first connecting terminals 4*a* to 4*c* and the plural second connecting terminals 6*a* to 6*c* and the plural isolating plates 8*a* to 8*d*, and whose head 12*b* is pressed against the adjacent isolating plate 8*a*, to thereby collectively fix the plural first connecting terminals 4*a* to 4*c* and the plural second connecting terminals 6*a* to 6*c* at the contacts therebetween, for electrical connections between the plural first connecting terminals 4*a* to 4*c* and the plural second connecting terminals 6*a* to 6*c*, respectively. At least a portion of the connecting member 9, which penetrates each contact, is formed of a nonconductive (i.e., not electrically conductive) and heat-conducting material.

The first terminal housing 5 may be a male terminal housing or a female terminal housing. This embodiment is exemplified in which the first terminal housing 5 is constructed as a male terminal housing.

First Connecting Terminals 4*a* to 4*c*

The first connecting terminals 4*a* to 4*c* are plate terminals, and are held to be aligned at a specified pitch by being spaced apart from each other by a molded resin material 10 formed of a nonconductive resin (e.g., PPS (polyphenylene sulfide) resin, PPA (polyphthalamide) resin, PA (polyamide) resin, PBT (polybutylene terephthalate), epoxy based resin), which forms a portion of the male terminal housing 5. As a method for holding the first connecting terminals 4*a* to 4*c* with the molded resin material 10, there is a holding method by inserting the first connecting terminals 4*a* to 4*c* during molding of the molded resin material 10 and then curing the resin, or a holding method by pressing the first connecting terminals 4*a* to 4*c* into the molded resin material 10 which has been molded beforehand.

The first connecting terminals 4*a* to 4*c* are each supplied with electricity at different voltages and/or currents. For example, in this embodiment, power lines are assumed to be for three phase alternating current between a motor and an inverter, so that the first connecting terminals 4*a* to 4*c* are supplied with alternating currents, respectively, which are 120 degrees out of phase with each other. For the purpose of reducing the loss of power transmitted through the connector 1, the first connecting terminals 4*a* to 4*c* may be each formed of a metal such as a high conductivity silver, copper, aluminum, or the like. Also, the first connecting terminals 4*a* to 4*c* each have slight flexibility.

Isolating Plates 8*a* to 8*d*

The plural isolating plates 8*a* to 8*d* comprise the plural first isolating plates 8*a* to 8*c* aligned and accommodated in the male terminal housing 5, and integrally fixed to one side of the plural first connecting terminals 4*a* to 4*c*, respectively, (i.e. to the opposite side to the side joined with the second connecting terminals 6*a* to 6*c*), and the second isolating plate 8*d* provided to be integrally fixed to an inner surface of the male terminal housing 5, and to face one side of the second connecting terminal 6*c* (i.e. the opposite side to the side joined with the first connecting terminal 4*c*) positioned at the outermost side when stacking the plural first connecting terminals 4*a* to 4*c* and the plural second connecting terminals 6*a* to 6*c*.

The plural isolating plates 8*a* to 8*d* are fixed at such a position as to protrude from the tips of the first connecting terminals 4*a* to 4*c*. Each of these isolating plates 8*a* to 8*d* is chamfered at each of its corners on the second connecting terminal 6*a* to 6*c* inserting/removing side.

Figure 5:
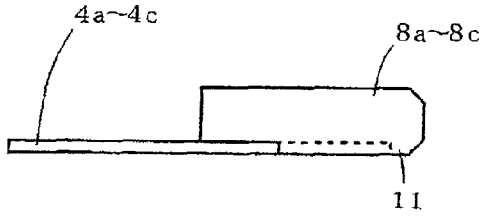
FIG. 5 is a side view showing a first connecting terminal of the first connector portion in FIG. 4.

Also, referring to FIG. 5, each of the plural first isolating plates 8*a* to 8*c* is formed with a protruding portion (i.e., thickened surface) 11 of its surface fixed to the first connecting terminals 4*a* to 4*c* to fill the level difference therebetween, so that the lower surfaces (i.e., the bottom faces in FIG. 5) of the plural first isolating plates 8*a* to 8*c* are flush with the lower surfaces (i.e., the bottom faces in FIG. 5) of the first connecting terminals 4*a* to 4*c*. Due to this construction, when the first connector portion 2 is fitted into the second connector portion 3, the tips of the first connecting terminals 4*a* to 4*c* do not contact the inserted tips of the second connecting terminal 6*a* to 6*c*. The insertability of the second connecting terminal 6*a* to 6*c* can be therefore enhanced. In FIG. 5, the structure of the first isolating plate 8*a* is depicted as being simplified such that the first isolating plates 8*a* to 8*c* are depicted likewise.

Connecting Member/First Terminal Housing

In the connection structure of the embodiment, although detailed later, heat generated from each contact is dissipated through the connecting member 9 and the first terminal housing 5 to the outside of the first terminal housing 5.

In other words, in the embodiment, the connecting member 9 and the first terminal housing 5 compose the heat-dissipating route for dissipating heat from each contact to the outside of the first terminal housing 5. The connecting member 9 and the first terminal housing 5 will be first explained below, while the heat-dissipating route is detailed later.

Connecting Member 9

The connecting member 9 will be explained below.

Referring again to FIG. 4, the connecting member 9 has a main body 12 comprised of the head 12*b* and the shaft 12*a* which is connected to the head 12*b* and penetrates each contact, and a nonconductive layer (or nonconductive portion) 13 which is of a nonconductive material and covers a outer circumference of the main body 12 except the a tip section 12*c* of the shaft 12*a*. Although detailed later, the main body 12 (i.e., the head 12*b* and the shaft 12*a*) is formed of a metal. The connecting member 9 is desirably in thermally close contact with the first connecting terminals 4*a* to 4*c* and/or the second connecting terminal 6*a* to 6*c* composing each contact in order to enhance the heat conduction from each contact.

The connecting member 9 is to collectively fix the first connecting terminals 4*a* to 4*c*, the second connecting terminals 6*a* to 6*c* and the isolating plates 8*a* to 8*d* at each contact for electrical connection therebetween by pressing them in the stacking direction as described earlier, and further to form a part of the heat-dissipating route for positively dissipating heat generated from each contact to the outside of the first terminal housing 5.

The main body 12 is formed of a metal such as SUS, iron and a copper alloy. In the embodiment, the main body 12 is a metallic bolt (with hexagonal hole). A male screw 18 is formed on the tip section 12*c* of the shaft 12*a*.

The nonconductive layer 13 is formed of a nonconductive and heat-conducting material. In the embodiment, the nonconductive and heat-conducting material for the nonconductive layer 13 may be a mixture of ceramic fillers such as alumina and aluminum nitride and a nonconductive resin (e.g., PPS (polyphenylene sulfide) resin, PPA (polyphthalamide) resin, PA (polyamide) resin, PBT (polybutylene terephthalate), epoxy based resin).

The material for the nonconductive layer 13 is not limited to the above material and may be only the nonconductive resin without mixing the filler or only the ceramic. In case of only the nonconductive resin, the nonconductive layer 13 may have insufficient thermal conductivity. In case of only the ceramic, the manufacturing cost will increase and therefore the nonconductive layer 13 uses desirably the material that the ceramic fillers are mixed into the nonconductive resin. In addition, as the nonconductive resin for the nonconductive layer 13, a resin is preferably used that has a linear expansion coefficient close to that of a metal forming the main body 12 to prevent creep.

The connecting member 9 may be entirely formed of a nonconductive and heat-conducting material. However, since the nonconductive and heat-conducting material is low in strength and thermal conductivity as compare to metals, the connecting member 9 is preferably structured by coating the outer circumference of the shaft 12*a* of the main body 12 with the nonconductive layer 13 the from the point of view of strength and thermal conductivity. Thus, the connecting member 9 having the metallic main body 12 and the nonconductive layer 13 covering the outer circumference of the shaft 12*a* can have enhanced strength as compared to the connecting member 9 entirely formed of the nonconductive and heat-conductive material.

A heat-insulating cap 12*d* is attached on the head 12*b* of the main body 12 (hereinafter called head 12*b* of the connecting member 9 for simplification) for preventing the heated connecting member 9 from being erroneously touched by fingers. The heat-insulating cap 12*d* is formed of a thermally nonconductive resin.

The head 12*b* of the connecting member 9 is provided with a packing 14 therearound for preventing water from penetrating into the first terminal housing 5. Also, between the lower surface of the head 12*b* of the connecting member 9 and the upper surface of the first isolating plate 8*a* directly therebelow is provided an elastic member 15 for applying a specified pressing force to the first isolating plate 8*a*. The elastic member 15 is a spring formed of a metal (e.g. SUS, or the like). In this embodiment, the elastic member 15 constitutes a portion of the connecting member 9. In other words, the connecting member 9 includes the metallic elastic member 15 that is disposed between the head 12*b* and the adjacent first isolating plate 8*a* for pressing sequentially the plural first isolating plates 8*a* to 8*c* in the stacking direction (i.e., in the vertical direction in FIG. 3).

The first isolating plate 8*a* to contact the bottom of the elastic member 15 is formed with a recessed portion 16 in its upper surface (i.e., the surface for the first isolating plate 8*a* adjacent to the head 12*b* to contact the elastic member 15) which covers (or accommodates) the lower portion of the elastic member 15. At the bottom (i.e. a seat portion for contacting the bottom of the elastic member 15) of the recessed portion 16 is provided a receiving member 17 made of a metal (e.g. SUS, or the like) which receives the elastic member 15 for preventing damage to the first isolating plate 8*a* formed of a nonconductive resin.

The connecting member 9 is inserted into the first terminal housing 5 from the top side (i.e., the top side in FIG. 3) of the first connecting terminal 4*a* to 4*c* on which the first isolating plates 8*a* to 8*c*, respectively are fixed. Then, the male screw 18 threaded on the tip section 12*c* of the shaft 12*a* is screwed into a male screw (or screw hole) 19 formed in an inner surface of the first terminal housing 5, to thereby allow the connecting member 9 to press the plural first connecting terminals 4*a* to 4*c* and the plural second connecting terminals 6*a* to 6*c* from the head 12*b* toward the tip section 12*c* of its shaft 12*a* (in FIG. 3, downward from above), and collectively fix them at each contact for electrical connections therebetween.

First Terminal Housing 5

The first terminal housing 5 will be explained below.

The first terminal housing 5 includes a hollow cylindrical body 20 formed substantially rectangular in transverse cross section. The first terminal housing 5 protects each contact by being fitted into the second terminal housing 7, and forms a part of the heat-dissipating route for positively dissipating heat generated from each contact to the outside of the first terminal housing 5.

An outer circumference at one end (rightward in FIG. 4) of the cylindrical body 20 fitted into the second terminal housing 7 is formed in a tapered shape, taking the fitting property into the second connector portion 3 into consideration. Also, on the outer circumference at one end of the cylindrical body 20 is provided a terminal housing waterproofing structure 21 for having the seal between the first connector portion 2 and the second connector portion 3. The terminal housing waterproofing structure 21 includes a recessed portion 22 formed in an outer portion at the open end of the cylindrical body 20, and a packing 23 provided in the recessed portion 22, such as an O-ring.

At the other end (leftward in FIG. 4) of the cylindrical body 20 is accommodated a molded resin material 10 with the first connecting terminals 4*a* to 4*c* aligned and held therewith. On the outer circumference at the other end of the cylindrical body 20 is formed a flange 24 (its attachment hole omitted) for fixing the first connector portion 2 to a device chassis (e.g. a motor shield case). The first terminal housing 5 is to thermally contact the device chassis via the flange 24 so as to dissipate heat from the first terminal housing 5 to the device side. At a rim 25 of the flange 24 may be provided a packing for having the seal between the first connector portion 2 and the device chassis.

At the upper part (upward in FIG. 4) of the cylindrical body 20 is formed a connecting member insertion hole 26 for inserting the connecting member 9. The connecting member insertion hole 26 is formed in a cylindrical shape, and bent inward at the lower end (downward in FIG. 4) of that cylindrical shape. A rim of the lower surface of the head 12*b* of the connecting member 9 contacts the bent portion of the connecting member insertion hole 26, to thereby regulate the stroke of the connecting member 9.

As shown in FIG. 3, the head 12*b* of the connecting member 9 contacts the first terminal housing 5 at its bottom face, i.e., at the edge section of the surface opposite the first isolating plate 8*a* to be in thermally close contact with it. As mentioned earlier, the shaft 12*a* (hereinafter called shaft 12*a* of the connecting member 9 for simplification) of the main body 12 of the connecting member 9 is screwed at the male screw 18 formed on the tip section 12*c* into the female screw 19 formed on the first terminal housing 5 so as to be in thermally close contact with it. Thus, the connecting member 9 is in thermally close contact with the first terminal housing 5 both at the head 12*b* and at the tip section 12*c* of the shaft 12*a*.

For shielding performance, heat dissipation, and weight reduction of the connector 1, the cylindrical body 20 is formed of, preferably a high electrical conductivity, high thermal conductivity and lightweight metal such as an aluminum, but may be formed of a thermally conductive resin, or the like. In the embodiment, the cylindrical body 20 is formed of aluminum. The cylindrical body 20 formed of aluminum as above allows the connecting member 9 to be firmly tightened into the screw hole 19 when screwed thereinto, compared with the cylindrical body 20 formed of an insulating resin.

Second Connector Portion 3

Figure 6:
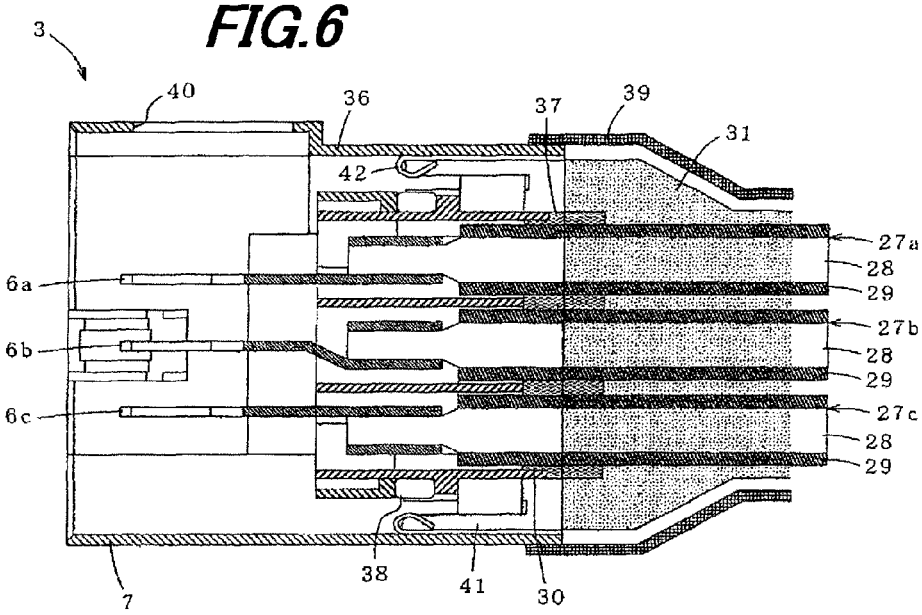
FIG. 6 is a cross-sectional view showing the second connector portion of the connector in FIG. 1.

Referring to FIG. 6, the second connector portion 3 has the second terminal housing 7 with plural (three) second connecting terminals (female terminals) 6*a* to 6*c* aligned and accommodated therein. In the embodiment, the connector portion with the female terminals is called the second connector portion 3. The second terminal housing 7 may be a male terminal housing or a female terminal housing. In the embodiment, the first terminal housing 5 is used as the male terminal housing, and the second terminal housing 7 is used as the female terminal hosing.

The second connecting terminals 6*a* to 6*c* are connected with cables 27*a* to 27*c*, respectively, at one end, which extend from an inverter. The cables 27*a* to 27*c* are electrically connected to the first connecting terminals 4*a* to 4*c* via the second connecting terminals 6*a* to 6*c*, respectively, and therefore supplied with electricity at voltages and/or currents in correspondence to the second connecting terminals 6*a* to 6*c*, respectively. The cables 27*a* to 27*c* are constructed by forming an insulating layer 29 around a conductor 28. In this embodiment, the conductor 28 used has a cross section of 20 $mm^2$.

The cables 27*a* to 27*c* are held and aligned at a specified pitch by a multi-cylindrical cable holding member 30. Due to the cable holding member 30, when the first connector portion 2 is fitted into the second connector portion 3, the second connecting terminals 6*a* to 6*c* are each held and positioned below the first connecting terminals 4*a* to 4*c* to face (i.e. to be connected to) the second connecting terminals 6*a* to 6*c* to form pairs respectively.

The cable holding member 30 is formed of a nonconductive resin, to isolate the second connecting terminals 6*a* to 6*c* from each other to prevent a short circuit. The cable holding member 30 allows the second connecting terminals 6*a* to 6*c* to be held at specified positions respectively, even when the cables 27*a* to 27*c* respectively connected to the second connecting terminals 6*a* to 6*c* are excellent in flexibility. That is, in this embodiment, the cables 27*a* to 27*c* with excellent flexibility can be used, and therefore enhance a degree of freedom of wiring the cables 27*a* to 27*c*.

Although the second connecting terminals 6*a* to 6*c* are positioned by the cable holding member 30 holding the cables 27*a* to 27*c*, more specifically, the ends near the second connecting terminals 6*a* to 6*c* of the cables 27*a* to 27*c* to hold the second connecting terminals 6*a* to 6*c* at specified positions respectively, the second connecting terminals 6*a* to 6*c* may be positioned by the cable holding member 30 holding the cables 27*a* to 27*c*, and the second connecting terminals 6*a* to 6*c* directly. Also, a connecting terminal holding member may, in place of the cable holding member 30, be used that holds not the cables 27*a* to 27*c*, but the second connecting terminals 6*a* to 6*c* directly.

In the case that, with the cable holding member 30, the second connecting terminals 6*a* to 6*c* are positioned by holding the cables 27*a* to 27*c* without directly holding the second connecting terminals 6*a* to 6*c*, that is, in the case of this embodiment, making the cables 27*a* to 27*c* flexible allows the tips of the second connecting terminals 6*a* to 6*c* to have flexibility relative to the second terminal housing 7. This construction permits flexible adaptation, even to deformation of first connecting terminal 4*a* to 4*c* portions to insert the second connecting terminals 6*a* to 6*c* in the first connector portion 2, when pressed by the connecting member 9.

Also, a braided shield 31 is wrapped around cables 27*a* to 27*c* portions drawn out of the second terminal housing 7, for the purpose of enhancement in shielding performance. This braided shield 31 contacts a later-described cylindrical shield body 41, and is electrically connected to the first terminal housing 5 (an equipotential (GND)) through the cylindrical shield body 41. For simplification, the braided shield 31 is not shown in FIG. 1.

Second Connecting Terminals 6*a* to 6*c*

Figure 7A:
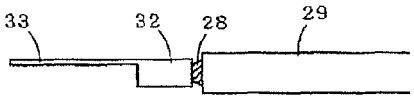
FIGS. 7A and 7B are a side view and a bottom view, respectively, showing a second connecting terminal of the second connector portion in FIG. 6.
Figure 7B:
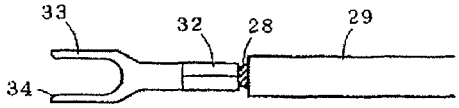
Figure 8A:
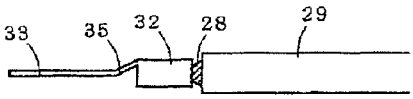
FIGS. 8A and 8B are a side view and a bottom view, respectively, showing a second connecting terminal of the second connector portion in FIG. 6.
Figure 8B:
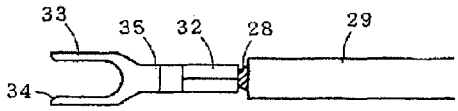

Referring to FIGS. 7 and 8, the second connecting terminals 6*a* to 6*c* respectively include calking portions 32 for calking the conductors 28 exposed from the tips of the cables 27*a* to 27*c*, and U-shaped contacts 33 formed integrally with the calking portions 32. At the tips of the U-shaped contacts 33 are respectively formed tapered portions 34 to enhance the insertability of the U-shaped contacts 33. When the first connector portion 2 is fitted into the second connector portion 3, the U-shaped contacts 33 are inserted in such a manner as to grip the shaft 12*a* of the connecting member 9.

In this embodiment, to reduce the size of the connector 1, the cables 27*a* to 27*c* are aligned and held as close to each other as possible. To this end, as shown in FIG. 8, by bending a trunk 35 of the second connecting terminal 6*b* to be connected to the cable 27*b* arranged in the middle when aligned, the second connecting terminals 6*a* to 6*c* are disposed apart at the same pitch.

The second connecting terminals 6*a* to 6*c* may each be constructed of a high electrical conductivity metal such as silver, copper, aluminum, or the like, in order to reduce the loss of power transmitted through the connector 1. Also, the second connecting terminals 6*a* to 6*c* each have slight flexibility.

Second Terminal Housing 7

Referring again to FIG. 6, the second terminal housing 7 includes a cylindrical hollow body 36 formed substantially rectangular in transverse cross section. To fit the first terminal housing 5 into the second terminal housing 7, an inner portion at one end (leftward in FIG. 6) of the cylindrical body 36 fitted to the first terminal housing 5 is formed in a tapered shape, taking the fitting property (or fitting ability) to the first terminal housing 5 into consideration.

By contrast, the second terminal housing 7 may be fitted into the first terminal housing 5. In this case, the inner portion at one end of the cylindrical body 20 composing the first terminal housing 5 may be tapered, the outer portion at one end of the cylindrical body 36 composing the second terminal housing 7 may be tapered, and the terminal housing waterproofing structure 21 may be formed on the outer portion at one end of the cylindrical body 36.

In the other end (rightward in FIG. 6) of the cylindrical body 36 is accommodated the cable holding member 30 with the cables 27*a* to 27*c* aligned and held therewith. On a cable insertion side of the cable holding member 30 is formed a packingless sealing portion 37, to prevent water from penetrating onto the cables 27*a* to 27*c* and into the second terminal housing 7. In an outer portion of the cable holding member 30 is provided a packing 38 to contact an inner surface of the first terminal housing 5. That is, the connector 1 has a double waterproofing structure including both the packing 23 of the terminal housing waterproofing structure 21 and the packing 38 provided in the outer portion of the cable holding member 30.

Further, the other end of the cylindrical body 36 from which the cables 27*a* to 27*c* are drawn out is covered with a rubber boot 39 for preventing water from penetrating into the cylindrical body 36. For simplification, the rubber boot 39 is not shown in FIGS. 1 and 2.

Also, in an upper portion (upward in FIG. 6) of the cylindrical body 36 is formed a connecting member manipulation hole 40 for manipulating the connecting member 9 provided in the first connector portion 2 when the first connector portion 2 and the second connector portion 3 are connected with each other. The connecting member manipulation hole 40 also functions as a through-hole for inserting/removing the connecting member 9 therethrough into/from the first terminal housing 5, after the first terminal housing 5 is fitted into the second terminal housing 7. Due to the through-hole function, the connecting member 9 can be removed through the connecting member manipulation hole 40 even when the first connector portion 2 is fitted into the second connector portion 3. For example, when the packing 14 around the head 12*b* of the connecting member 9 deteriorates with age and has to be changed, the connecting member 9 can be removed to change or fix the packing 14 through the connecting member manipulation hole 40 without removing the second connector portion 3 from the first connector portion 2. Thus, convenience in maintenance thereof can be improved.

For shielding performance, heat dissipation, and weight reduction of the connector 1, the cylindrical body 36 is formed of, preferably a high electrical conductivity, high thermal conductivity and lightweight metal such as an aluminum, but may be formed of a resin, or the like. In this embodiment, the cylindrical body 36 is formed of a nonconductive resin. Therefore, to enhance its shielding performance and heat dissipation, the cylindrical shield body 41 of aluminum is provided on an inner surface at the other end of the cylindrical body 36.

The cylindrical shield body 41 includes a contact 42 to contact an outer portion of the first terminal housing 5 of aluminum when the first connector portion 2 is fitted into the second connector portion 3. The cylindrical shield body 41 is thermally and electrically connected with the first terminal housing 5 via the contact 42. This enhances the shielding performance and the heat dissipation.

Connection Between the First Connector Portion 2 and the Second Connector Portion 3

Figure 9:
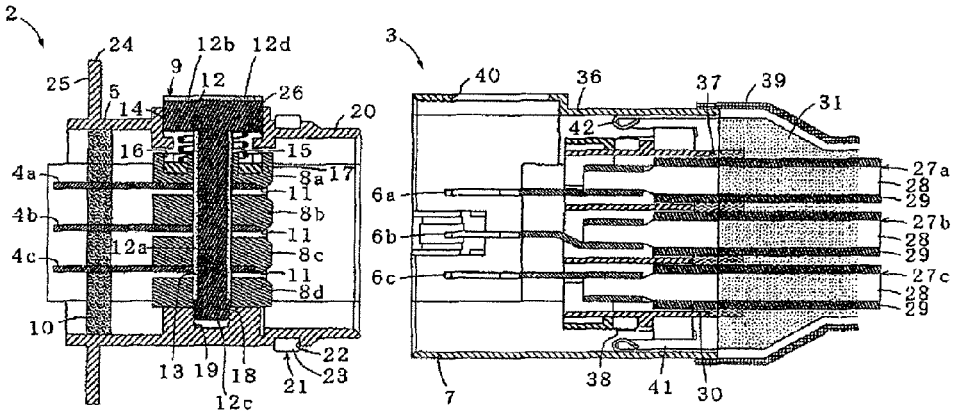
FIG. 9 is a cross-sectional view showing the first connector portion and the second connector portion of the connector in FIG. 1 before being fitted each other.

When the first connector portion 2 is, as shown in FIG. 3, fitted into the second connector portion 3 from an unmated state as shown in FIG. 9, the second connecting terminals 6*a* to 6*c* are each inserted between the first connecting terminals 4*a* to 4*c*, respectively, and the isolating plates 8*a* to 8*d*, respectively, where the first connecting terminals 4*a* to 4*c* and the second connecting terminals 6*a* to 6*c* form pairs respectively. With this insertion, the plural first connecting terminals 4*a* to 4*c* and the plural second connecting terminals 6*a* to 6*c* then face each other to form pairs, respectively, and result in a stacked structure in which the pairs of the first connecting terminals 4*a* to 4*c* and the second connecting terminals 6*a* to 6*c* and the isolating plates 8*a* to 8*d* are disposed alternately, i.e. the pairs of the first connecting terminals 4*a* to 4*c* and the second connecting terminals 6*a* to 6*c* are alternately interleaved with the isolating plates 8*a* to 8*d*.

In this case, inside the first connector portion 2, the isolating plates 8*a* to 8*c* are respectively fixed to the tips of the first connecting terminals 4*a* to 4*c* held and aligned at a specified pitch. Therefore, a pitch between the isolating plates 8*a*, 8*b* and 8*c* can be held, even without separately providing a holding jig (see JP patent No. 4037199) for holding the pitch between the isolating plates 8*a*, 8*b* and 8*c*. This allows the second connecting terminals 6*a* to 6*c*, respectively, to be easily inserted between the first connecting terminals 4*a* to 4*c*, respectively, and the isolating plates 8*a* to 8*d*, respectively, where the first connecting terminals 4*a* to 4*c* and the second connecting terminals 6*a* to 6*c* form the pairs respectively. That is, the insertability/removability of the second connecting terminals 6*a* to 6*c* does not lower. Also, because of no need to provide the holding jig for holding the pitch between the isolating plates 8*a*, 8*b* and 8*c*, a further size reduction can very effectively be achieved, compared to the prior art.

Also, the contact between the first connecting terminal 4*a* (or 4*b*) and the second connecting terminal 6*a* (or 6*b*) is sandwiched between the first isolating plate 8*a* (or 8*b*) fixed to the first connecting terminal 4*a* (or 4*b*) constituting the contact, and the first isolating plate 8*b* (or 8*c*) fixed to the first connecting terminal 4*b* (or 4*c*) constituting the other contact. Likewise, the contact between the first connecting terminal 4*c* and the second connecting terminal 6*c* is sandwiched between the first isolating plate 8*c* fixed to the first connecting terminal 4*c* constituting the contact, and the second isolating plate 8*d* fixed to the inner surface of the male terminal housing 5.

Then, as shown in FIG. 3, the connecting member 9 is manipulated through the connecting member manipulation hole 40, to screw and tighten the screwing portion 18 of the connecting member 9 into the screw hole 19 of the male terminal housing 5. The connecting member 9 is then rotated and pressed into the bottom of the screw hole 19, and causes the elastic member 15 to, in turn, press the first isolating plate 8*a*, the first isolating plate 8*b*, the first isolating plate 8*c*, and the second isolating plate 8*d*, and sandwich the contacts between the isolating plates 8*a* and 8*b*, between the isolating plates 8*b* and 8*c*, and between the isolating plates 8*c* and 8*d*, respectively, with the contacts isolated from each other. In this case, by being pressed by the isolating plates 8*c* and 8*d*, the first connecting terminals 4*a* to 4*c* and the second connecting terminals 6*a* to 6*c* are slightly bent and contacted with each other, respectively, in a wide range.

This allows each contact to be firmly contacted and fixed, even in a vibrational environment such as on vehicle. In other words, by pressing the plural pairs and the plural isolating plates 8*a* to 8*d* by using the connecting member 9, the first connecting terminals 4*a* to 4*c*, the second connecting terminal 6*a* to 6*c* and the isolating plates 8*a* to 8*d* are fixed and contacted with each other so as to prevent mutually the relative movement to the slight slides.

Heat-Dissipating Route

The heat-dissipating route of the connection structure in the embodiment will be explained below.

As described earlier, the connector 1 used for the power harness used in large power transmission has the key problem of how to dissipate heat generated at the contact due to the large power transmission.

The connection structure of the embodiment is constructed such that heat generated from each contact is dissipated through the connecting member 9 and the first terminal housing 5 to the outside of the first terminal housing 5.

Figure 10:
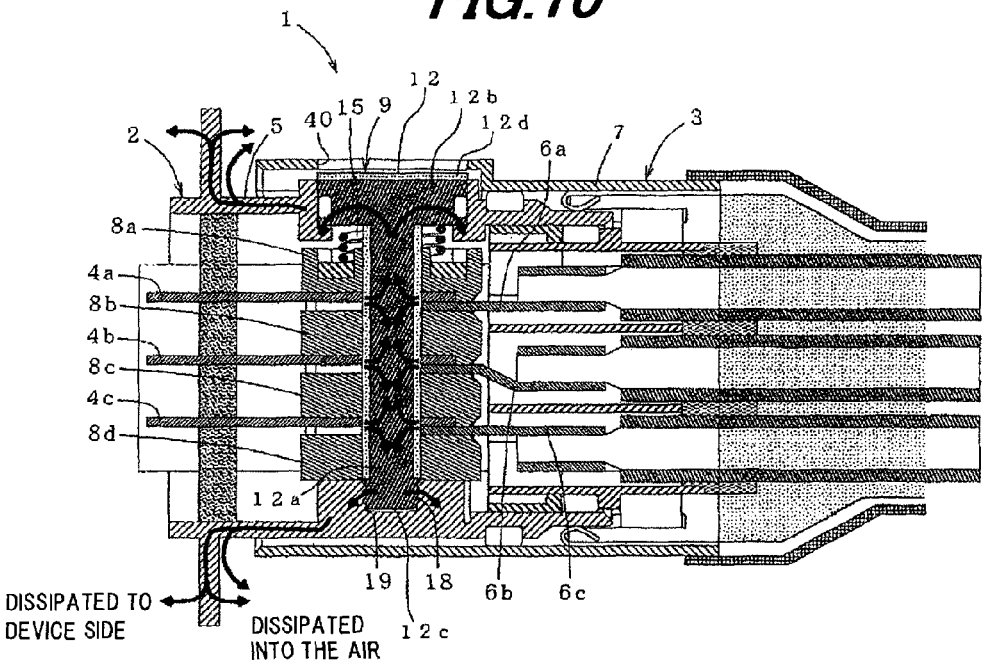
FIG. 10 is a cross-sectional view showing a heat-dissipating route of the connector in FIG. 1.

For example, as shown in FIG. 10, heat generated at each contact is first conducted to the shaft 12*a* of the main body 12 through the nonconductive layer 13 of the connecting member 9 contacting with each contact. In this case, since the nonconductive layer 13 is formed of the nonconductive and heat-conducting resin, heat generated at each contact is smoothly conducted to the shaft 12*a* of the metallic main body 12.

The main body 12 is in thermally close contact with the first terminal housing 5 both at the head 12*b* and at the tip section 12*c* of the shaft 12*a*, so that heat conducted from each contact to the shaft 12*a* can be conducted through the shaft 12*a* in the axis direction, and then conducted through the head 12*b* or the tip section 12*c* of the shaft 12*a* to the first terminal housing 5.

Then, heat conducted to the first terminal housing 5 is dissipated through the flange 24 to the device side or directly from the surface of the first terminal housing 5 to the outside (i.e., into the air around the first terminal housing 5).

Effects and Functions of the Embodiment

As described above, the connection structure of the embodiment is constructed such that heat generated from each contact is dissipated through the connecting member 9 and the first terminal housing 5 to the outside of the first terminal housing 5.

The connecting member 9, which serves to collectively fix at each contact the plural first connecting terminals 4*a* to 4*c* and the plural second connecting terminal 6*a* to 6*c* for electrical connection therebetween by pressing the adjacent isolating plate 8*a*, also serves as a heat-dissipating route for dissipating heat generated from each contact to the outside of the first terminal housing 5. Thus, the effective heat-dissipating route can be completed without increasing the number of parts.

In the embodiment, the nonconductive layer 13 is formed of the nonconductive and heat-conducting resin. Therefore, heat generated at each contact can be smoothly conducted to the metallic main body 12 while securing the insulation between the contacts to enhance the heat dissipation efficiency.

In the embodiment, the flange 24 is integrally formed on one end of the first terminal housing 5. Therefore, by provide thermally close contact with the first terminal housing 5 via the flange 24 to the device chassis, heat conducted to the first terminal housing 5 from each contact can be dissipated through the flange 24 to the device side.

In general, devices to which the connector 1 is connected are designed to have large heat capacity. Therefore, by providing thermally close contact with the first terminal housing 5 to the device chassis, heat conducted to the first terminal housing 5 from each contact can be guided to the device side and efficiently dissipated outside the first terminal housing 5. In addition, the surface area of the first terminal housing 5 can be increased by forming the flange 24 so as to increase the amount of heat dissipated from the surface of the first terminal housing 5 to enhance the heat dissipation efficiency.

In the embodiment, the heat-insulating cap 12*d* is disposed on the head 12*b* of the connecting member 9. This can prevent fingers from touching the heated connecting member 9 to improve the safety.

In the embodiment, each contact is sandwiched and pressed by two of the isolating plates 8*a* to 8*d* such that each of the first connecting terminals 4*a* to 4*c* and each of the second connecting terminal 6*a* to 6*c* can be collectively fixed and electrically connected by each contact to stabilize the connection force of each contact. Thereby, the connector can be effective especially for automobiles that are subjected to vibration while driving.

In the embodiment, an example of forming the flange 24 on the first terminal housing 5 has been described. However, the flange 24 may be formed on the second connector portion 3 or on both of the first connector portion 2 and the second connector portion 3. Furthermore, the first connector portion 2 and the second connector portion 3 may not be fixed to the device chassis.

For example, when the second terminal housing 7 is provided with the flange, the second terminal housing 7 may be formed of a heat-conducting resin or metal and the first terminal housing 5 may be in thermally close contact with the second terminal housing 7. Thereby, heat generated at each contact can be dissipated through the connecting member 9, the first terminal housing 5 and the second terminal housing 7 to the device side. The thermal contact construction of the first terminal housing 5 and the second terminal housing 7 is not specifically limited. For example, as in the connector 1 in FIG. 3, the first terminal housing 5 and the second terminal housing 7 may be in thermally close contact with each other via the contact 42 of the cylindrical shield body 41.

In the embodiment, the head 12*b* of the connecting member 9 and the tip section 12*c* of the shaft 12*a* are in thermally close contact with the first terminal housing 5. However, only one of them may be in thermally close contact with the first terminal housing 5.

In the embodiment, the connecting member 9 is in thermally close contact with the first terminal housing 5. However, the connecting member 9 may be in thermally close contact with the second terminal housing 7 without via the first terminal housing 5. This construction is effective especially for the case that the second terminal housing 7 is provided with the flange (i.e., the second terminal housing 7 is made to thermally contact the device chassis).

The thermal contact construction of the connecting member 9 to the second terminal housing 7 is not specifically limited. For example, the first terminal housing 5 may be provided with a through-hole instead of the female screw 19 and the second terminal housing 7 may be provided with a female screw for screwing the male screw 18, so that the connecting member 9 can be in thermally close contact with the second terminal housing 7 by screwing the male screw 18 into the female screw of the second terminal housing 7. Alternatively, the female screw may be formed on both sides of the first terminal housing 5 and the second terminal housing 7.

In the embodiment, the heat-dissipating route of the connection structure can be called a connection member mediated heat-dissipating route since heat generated at each contact is conducted from the contact through the connecting member 9 to the first terminal housing 5 contacting the outside device. The connection member mediated heat-dissipating route of the embodiment has two routes, i.e., one is a route via the head 12*b* of the connecting member 9 and the other is a route via the shaft 12*a* of the connecting member 9. However, one of the two routes may be used.

In the embodiment, the heat-dissipating route of the connection structure is made such that the connecting member 9 passing through the contacts. Thereby, heat dissipation can be done directly from the contacts where heat is most caused to maximize the heat dissipation effect. Furthermore, since only one member, the connecting member 9 is needed for dissipating heat from the plural contacts, the number of parts can be advantageously reduced as compared to the case that one heat-dissipating route is needed for each contact.

Other Embodiments

The other embodiments of the invention will be described below.

Figure 11:
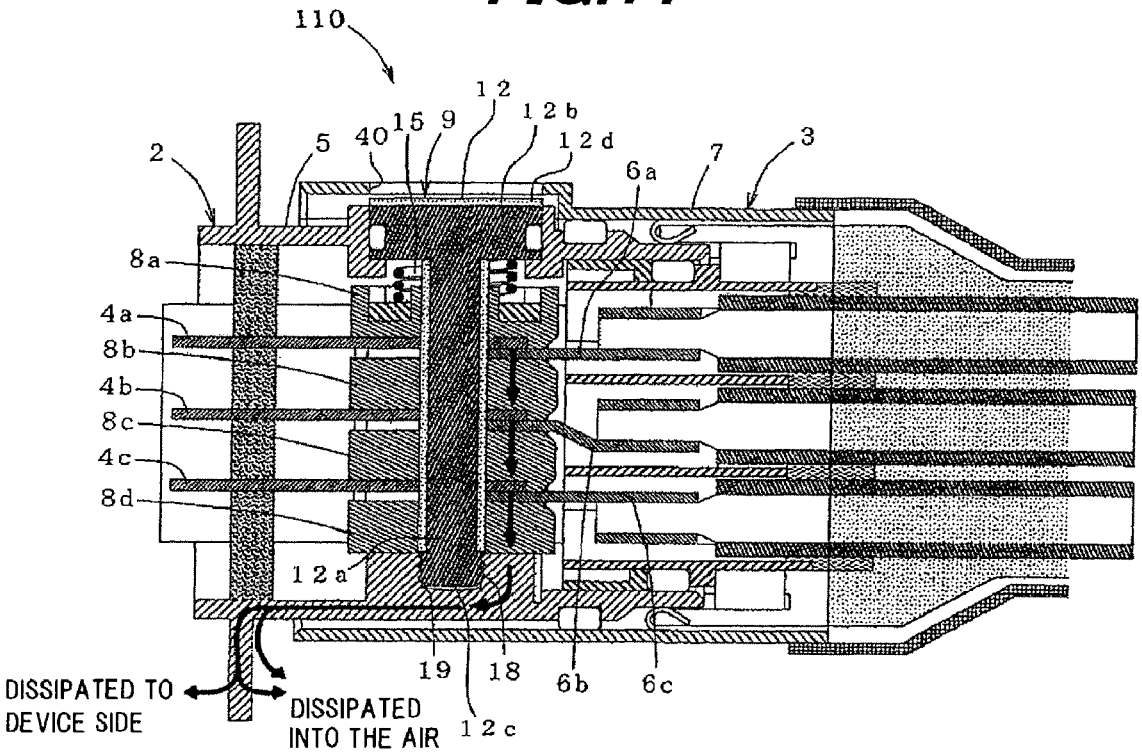
FIG. 11 is a cross-sectional view showing a heat-dissipating route of a connector in another embodiment according to the invention.

A connector 110 in FIG. 11 has basically the same construction as the connector 1, but the heat-dissipating route for dissipating heat generated at each contact to the outside of the first terminal housing 5 is different from each other.

For example, the connector 110 is constructed such that the isolating plates 8*a* to 8*d* are formed of the nonconductive and heat-conducting resin, and at least one of the isolating plates 8*a* to 8*d* is in thermally close contact with the first terminal housing 5, in order to dissipate heat generated at each contact to the outside of the first terminal housing 5 through the isolating plates 8*a* to 8*d* and the first terminal housing 5. The connector 110 is provided with the connecting member 9 formed of a non-heat-conducting material.

Thus, the heat-dissipating route of the connector 110 is constructed by the isolating plates 8*a* to 8*d* instead of the connecting member 9. The nonconductive and heat-conducting material for the isolating plates 8*a* to 8*d* may be a mixture of ceramic fillers such as alumina and aluminum nitride and a nonconductive resin (e.g., PPS (polyphenylene sulfide) resin, PPA (polyphthalamide) resin, PA (polyamide) resin, PBT (polybutylene terephthalate), epoxy based resin).

In the connector 110, of the isolating plates 8*a* to 8*d*, the first isolating plate 8*a* and the second isolating plate 8*d* at both ends in the stacking direction are in thermally close contact with the first terminal housing 5. The first isolating plate 8*a* is in thermally close contact with the first terminal housing 5 via the elastic member 15 and the head 12*b* of the connecting member 9. The first isolating plate 8*d* is in thermally close contact with the first terminal housing 5 by contacting the proximity of the female screw 19.

The connector 110 is operable to dissipate heat generated at each contact through the isolating plates 8*a* to 8*d* and the first terminal housing 5 to the outside of the first terminal housing 5. As in the connector 1 in FIG. 1, it can construct the effective heat-dissipating route without increasing the number of parts.

Specifically, the heat-dissipating route of the connection structure of the other embodiment can be called an insulating plate mediated heat-dissipating route since heat generated at each contact is conducted from the contact through the isolating plates 8*a* to 8*d* to the first terminal housing 5 contacting the outside device.

Although the connecting member 9 of the connector 110 is formed of the non-heat-conducting material, it may be formed of a heat-conducting material. Thus, the connector 110 may also construct the heat-dissipating route (i.e., the connecting member mediated heat-dissipating route) as described in FIG. 10. Thereby, the heat dissipation efficiency can be further enhanced to provide the more effective heat-dissipating route. In case of having both of the connecting member mediated heat-dissipating route and the insulating plate mediated heat-dissipating route, heat conduction can be also caused between the connecting member 9 and the isolating plates 8*a* to 8*d* by provide thermally close contact therebetween. Thus, the more effective heat-dissipating route can be constructed.

When the elastic member 15 as well as the connecting member 9 has the thermal conductivity, a heat-dissipating route can be constructed for dissipating heat generated at each contact in the order of the isolating plate 8*a*, the elastic member 15, the connecting member 9 and the first terminal housing 5.

Although the heat-insulating cap 12*d* is shown in FIG. 11, it may not be used since the temperature of the connecting member 9 does not rise so high as compared to the embodiment in FIG. 10.

Alterations

The invention is not limited to the above-described embodiments, but various alterations are possible in the scope not departing from the gist of the invention.

Although in the above embodiments, three phase alternating power lines have been assumed, according to the technical idea of the invention, the connector for a vehicle, for example, may be disposed to collectively connect lines for different uses, such as three phase alternating current power lines for between a motor and an inverter, two phase direct current power lines for an air conditioner, and the like. This disposition allows power lines for a plurality of uses to be collectively connected by one connector. There is therefore no need to prepare a different connector for each use, to thereby allow a contribution to space saving or low cost.

Although in the above embodiments, the first connecting terminals 4*a* to 4*c* and the second connecting terminals 6*a* to 6*c* are in surface contact with each other respectively, the first connecting terminal 4*a* to 4*c* contact side surfaces to be contacted with the second connecting terminals 6*a* to 6*c* may be formed with protruding portions, and the U-shaped contacts 33 of the second connecting terminals 6*a* to 6*c* may be fitted onto these protruding portions, respectively. This allows the further stabilization of the coupling force of the first connecting terminals 4*a* to 4*c* and the second connecting terminals 6*a* to 6*c*, respectively. That is, this is especially effective for vibration perpendicular to the connecting member 9.

Although in the above embodiments, the lengths of the branch tips of each U-shaped contact 33 of the second connecting terminals 6*a* to 6*c* are the same, one length thereof may be formed to be long to form a J-shaped contact. The J-shaped contact allows the second connector portion 3 to be inserted into the shaft 12*a* of the connecting member 9 obliquely relative to the cable longitudinal direction.

Although in the embodiments, when viewed from the head 12*b* of the connecting member 9, the first connecting terminals 4*a* to 4*c* and the second connecting terminals 6*a* to 6*c* have been disposed to be linearly contacted with each other respectively, the first terminal housing 5 and the second terminal housing 7 may be disposed so that, when viewed from the head 12*b* of the connecting member 9, the first connecting terminals 4*a* to 4*c* of the first connector portion 2 cross and contact the second connecting terminals 6*a* to 6*c* of the second connector portion 3 respectively at a right angle thereto. That is, the first connector portion 2 and the second connector portion 3 may be mated with each other in an L-shape. Likewise, the second terminal housing 7 and the second connecting terminals 6*a* to 6*c* may be disposed obliquely relative to the first terminal housing 5 and the first connecting terminals 4*a* to 4*c* respectively. By thus applying the gist of the invention, the direction of inserting/removing the second connector portion 3 relative to the first connector portion 2 may be varied. That is, the direction of drawing the cables out from the connector can be fitted to the shape of an installation portion, to thereby allow a contribution to space saving.

Although in the embodiments it has been described that, unlike the second connecting terminals 6*a* to 6*c*, the first connecting terminals 4*a* to 4*c* are not connected with cables respectively, the first connecting terminals 4*a* to 4*c* are not limited to this structure. Thus, the connector of the embodiments can be also used for connecting the cables together.

Although in the embodiments, the cables 27*a* to 27*c* used have excellent flexibility, rigid cables may be used.

Although in the embodiments, the female screw 19 is formed at such a position that it is screwed into the male screw 18 at the tip side of the connecting member 9, a male screw may be formed on the side of the head 12*b* of the connecting member 9 and the female screw 19 may be formed at such a position that it is screwed into the male screw formed on the side of the head 12*b*. For example, the male screw may be formed on the head 12*b* and the female screw 19 may be on the first terminal housing 5.

In case of forming the male screw on the side of the head 12*b*, the connection structure may be made such that the shaft 12*a* of the connecting member 9 is omitted so as to allow the connecting member 9 not to penetrate the contacts, and such that the plural first connecting terminals 4*a* to 4*c* and the plural second connecting terminal 6*a* to 6*c* are collectively fixed at each contact for electrical connection therebetween by pressing the first isolating plate 8*a* by the head 12*b* of the connecting member 9 and the elastic member 15. In this connection structure, the isolating plate mediated heat-dissipating route as shown in FIG. 11 becomes effective.

Although in the embodiments, the bolt 12 is exemplified as the connecting member 9, the connecting member 9 is not limited to the bolt shape. For example, the shaft of CPA (connector position assurance) for fixing the fitting of the first connector portion 2 and the second connector portion 3 may be used as the connecting member 9, and the CPA may be rotated to fix the fitting and to fasten the connecting member 9.

Although in the embodiments, the bolt is exemplified as the main body 12 of the connecting member 9, the main body 12 of the connecting member 9 is not limited to the bolt shape. For example, the shaft of CPA (connector position assurance) lever for fixing the fitting of the first connector portion 2 and the second connector portion 3 may be connected with the connecting member 9, and the CPA lever may be rotated to fix the fitting and to press (or fasten) the connecting member 9 from the head 12*a* toward the tip of the shaft 12*b*.

Although in the embodiments, the concave portion for fitting a hexagonal wrench (or a hexagonal spanner) thereinto is formed on the upper surface of the head 12*b* of the connecting member 9. This is assumed for using a commercial hexagonal wrench. In case of using a specified tool with a shape different from the commercial wrench, the concave portion may be formed corresponding the specified tool on the upper surface of the head 12*b* of the connecting member 9.

In the embodiments, while using the connector, the connecting member 9 may be substantially horizontal or substantially vertical. In other words, the use conditions of the connector in this embodiment require no orientation of the connecting member 9 in use.

Although the invention has been described with respect to the above embodiments, the above embodiments are not intended to limit the appended claims. Also, it should be noted that not all the combinations of the features described in the above embodiments are essential to the means for solving the problems of the invention.

What is claimed is:

1. A connection structure, comprising:

a first terminal housing with a plurality of first connecting terminals aligned and accommodated therein;

a second terminal housing with a plurality of second connecting terminals aligned and accommodated therein;

a plurality of isolating plates aligned and accommodated in the first terminal housing, wherein when the first terminal housing and the second terminal housing are fitted to each other, the plurality of first connecting terminals and the plurality of second connecting terminals face each other to form pairs, respectively, and a stacked state is exhibited such that pairs of the first connecting terminals and the second connecting terminals are alternately interleaved with the plurality of isolating plates; and a connecting member comprising a heat-conducting material and a main body including a head and a shaft connected to the head, the shaft being adapted to penetrate contacts between the plurality of first connecting terminals and the plurality of second connecting terminals and the plurality of isolating plates, the head being adapted to press an adjacent one of the plurality of isolating plates for collectively fixing the plurality of first connecting terminals and the plurality of second connecting terminals at the contacts for electrical connections between the plurality of first connecting terminals and the plurality of second connecting terminals, respectively, the connecting member further comprising at least a portion comprising a nonconductive material for penetrating the contacts, wherein the connection structure is adapted to dissipate heat generated at the contacts through the connecting member, the first terminal housing and/or the second terminal housing to an outside of the first terminal housing.

2. The connection structure according to claim 1, wherein the head of the main body is in thermally close contact with the first terminal housing and/or the second terminal housing so as to dissipate heat generated at the contacts through the head of the main body, the first terminal housing and/or the second terminal housing to the outside of the first terminal housing.

3. The connection structure according to claim 1, wherein the connecting member further comprises a nonconductive portion formed of a nonconductive material and covering an outer circumference of a part except a tip section of the shaft of the main body, the head and the shaft of the main body comprise a metal, and the tip section of the shaft of the main body is in thermally close contact with the first terminal housing and/or the second terminal housing.

4. The connection structure according to claim 3, wherein the tip section of the shaft of the main body comprises a male screw formed thereon, and the connecting member is fixed in thermally close contact with the first terminal housing and/or the second terminal housing by screwing the tip section of the shaft into a female screw formed on the first terminal housing and/or the second terminal housing.

5. The connection structure according to claim 1, wherein the head of the main body comprises a heat-insulating cap for preventing a human body part from touching the heated connecting member.

6. The connection structure according to claim 1, wherein the first terminal housing and/or the second terminal housing comprise a flange formed integrally on an outer circumference thereof for fixing the first terminal housing and/or the second terminal housing to a housing of an external device so as to allow the first terminal housing and/or the second terminal housing to have a thermally close contact with the housing of the external device, and the connection structure is adapted to dissipate heat generated at the contacts through the connecting member, the first terminal housing and/or the second terminal housing, and the flange to the external device.

7. The connection structure according to claim 1, wherein the plurality of isolating plates comprise a nonconductive and heat-conducting material, and at least one of the plurality of isolating plates is in thermally close contact with the first terminal housing and/or the second terminal housing so as to further dissipate heat generated at the contacts through the plurality of isolating plates, first terminal housing and/or the second terminal housing to the outside of the first terminal housing.

8. A connection structure, comprising:

a first terminal housing with a plurality of first connecting terminals aligned and accommodated therein;

a second terminal housing with a plurality of second connecting terminals aligned and accommodated therein;

a plurality of isolating plates aligned and accommodated in the first terminal housing, wherein when the first terminal housing and the second terminal housing are fitted to each other, the plurality of first connecting terminals and the plurality of second connecting terminals face each other to form pairs, respectively, and a stacked state is exhibited such that pairs of the first connecting terminals and the second connecting terminals are alternately interleaved with the plurality of isolating plates; and a connecting member comprising a heat-conducting material and a head, the head being adapted to press an adjacent one of the plurality of isolating plates for collectively fixing the plurality of first connecting terminals and the plurality of second connecting terminals at the contacts for electrical connections between the plurality of first connecting terminals and the plurality of second connecting terminals, respectively, wherein the plurality of isolating plates comprise a nonconductive and heat-conducting material, and at least one of the plurality of isolating plates is in thermally close contact with the first terminal housing and/or the second terminal housing so as to dissipate heat generated at the contacts through the plurality of isolating plates, first terminal housing and/or the second terminal housing to an outside of the first terminal housing.

9. The connection structure according to claim 1, wherein the first terminal housing and/or the second terminal housing comprise a metallic material.

10. The connection structure according to claim 8, wherein the first terminal housing and/or the second terminal housing comprise a metallic material.

11. The connection structure according to claim 1, wherein the first terminal housing and/or the second terminal housing comprise a heat-conducting resin.

12. The connection structure according to claim 8, wherein the first terminal housing and/or the second terminal housing comprise a heat-conducting resin.

* * * * *